US009120614B2

(12) United States Patent
Jones et al.

(10) Patent No.: US 9,120,614 B2
(45) Date of Patent: Sep. 1, 2015

(54) METHOD FOR PRESERVING THE FIRMNESS AND INTERNAL PRESSURE OF A RESIN CARTRIDGE AND IMPROVING THE SHELF-LIFE OF A RESIN CARTRIDGE

(75) Inventors: Roy Carlton Jones, Hagerstown, MD (US); Phillip Edwin Gramlich, Jr., Morgantown, WV (US); Jeffrey Thomas Gotro, Trabuco Canyon, CA (US); George Pesansky, Pottsville, PA (US); James Edward Pinkley, Aurora, CO (US)

(73) Assignee: DSI UNDERGROUND SYSTEMS, INC., Martinsburg, VA (US)

( * ) Notice: Subject to any disclaimer, the term of this patent is extended or adjusted under 35 U.S.C. 154(b) by 994 days.

(21) Appl. No.: 13/271,902

(22) Filed: Oct. 12, 2011

(65) Prior Publication Data

US 2012/0091016 A1 Apr. 19, 2012

Related U.S. Application Data

(60) Provisional application No. 61/392,773, filed on Oct. 13, 2010.

(51) Int. Cl.
*B65B 31/00* (2006.01)
*B65B 29/10* (2006.01)
(Continued)

(52) U.S. Cl.
CPC ..... *B65D 81/2046* (2013.01); *B65B 29/10* (2013.01); *B65B 31/00* (2013.01);
(Continued)

(58) Field of Classification Search
CPC ..... E21D 20/026; B65D 81/2061; B65D 81/2053; B65D 77/08; B65D 35/22; B65D 81/2046; B65B 2230/02; B65B 29/10; B65B 31/045; B65B 31/006; B65B 31/00
USPC ..... 53/403, 432, 433, 434, 449, 467, 79, 53/510, 511, 512, 170, 171, 237, 267, 53/284.5, 284.7
See application file for complete search history.

(56) References Cited

U.S. PATENT DOCUMENTS 1,207,813 A 12/1916 Stockton
4,124,117 A 11/1978 Rudy
(Continued)

OTHER PUBLICATIONS

International Search Report and Written Opinion dated Mar. 7, 2012 from PCT/US11/55978, 12 pages.
(Continued)

*Primary Examiner* — Stephen F Gerrity
(74) *Attorney, Agent, or Firm* — Ohlandt, Greeley, Ruggiero & Perle, L.L.P.

(57) ABSTRACT

An assembly for extending the shelf-life of a pressurized resin cartridge. The assembly includes at least one pressurized resin cartridge comprising a first compartment for holding a catalyst and a second compartment for holding a resin mastic. The assembly has a pressurized container sealingly disposed about the pressurized resin cartridge. Such assembly minimizes depressurization of the pressurized resin cartridge and extends the shelf-life of the pressurized resin cartridge. An assembly for extending the shelf-life of a depressurized resin cartridge. The assembly includes at least one depressurized resin cartridge comprising a first compartment for holding a catalyst and a second compartment for holding a resin mastic. The assembly has a pressurized container sealingly disposed about the depressurized resin cartridge. Such assembly increases pressurization of the depressurized resin cartridge and extends the shelf-life of the depressurized resin cartridge.

6 Claims, 10 Drawing Sheets

(51) Int. Cl.

| | |
|---|---|
| ***B65D 81/20*** | (2006.01) |
| ***E21D 20/02*** | (2006.01) |
| ***B65D 77/08*** | (2006.01) |

(52) U.S. Cl.

CPC ..... *B65B 31/006* (2013.01); *B65D 77/08* (2013.01); *B65D 81/2053* (2013.01); *B65D 81/2061* (2013.01); *E21D 20/026* (2013.01)

(56) References Cited

U.S. PATENT DOCUMENTS

| | | | | | |
|---|---|---|---|---|---|
| 4,127,976 | A * | 12/1978 | Jablonski et al. | ..... | 53/450 |
| 4,280,943 | A | 7/1981 | Bivens | | |
| 4,514,446 | A * | 4/1985 | Kadono et al. | ..... | 53/472 |
| 5,083,415 | A * | 1/1992 | Schneider et al. | ..... | 53/432 |
| 5,690,215 | A * | 11/1997 | Kimball et al. | ..... | 53/449 |
| 6,454,129 | B1 * | 9/2002 | Green | ..... | 222/94 |
| 6,545,068 | B1 | 4/2003 | Simmons et al. | | |
| 7,194,847 | B2 * | 3/2007 | Summons et al. | ..... | 53/433 |
| 7,681,377 | B2 | 3/2010 | Simmons et al. | | |
| 2006/0062949 | A1 * | 3/2006 | Hanaichi et al. | ..... | 428/35.2 |
| 2007/0017832 | A1 * | 1/2007 | Simmons et al. | ..... | 206/219 |
| 2008/0120947 | A1 * | 5/2008 | Oldsen et al. | ..... | 53/467 |
| 2008/0298904 | A1 | 12/2008 | Locotos | | |
| 2010/0183379 | A1 * | 7/2010 | Simmons et al. | ..... | 405/259.5 |
| 2011/0100470 | A1 * | 5/2011 | Vogus et al. | ..... | 137/1 |

OTHER PUBLICATIONS

PCT Notification of Transmittal of International Preliminary Report on Patentability dated Feb. 15, 2013 from corresponding International Patent Application No. PCT/US11/55978, 20 pages.

Patent Examination Report No. 1 dated Jan. 14, 2015 from corresponding Australian Patent Application No. 2011316631, pp. 4.

* cited by examiner

| Daily Pressure Log for Pressure Vessels | | | | | | | |
|---|---|---|---|---|---|---|---|
| Day | Vessel | 210 | 211 | 212 | 213 | 214 | 215 |
| 1 | Pressure | 32 | 30 | 27 | 42 | 40 | 36 |
| 2 | Pressure | 32 | 30 | 27 | 42 | 40 | 36 |
| 3 | Pressure | 32 | 30 | 27 | 42 | 40 | 36 |
| 4 | Pressure | 32 | 30 | 27 | 42 | 40 | 36 |
| 5 | Pressure | 32 | 30 | 28 | 42 | 40 | 36 |
| 6 | Pressure | 33 | 30 | 27 | 43 | 40 | 36 |
| 7 | Pressure | 33 | 30 | 27 | 44 | 40 | 36 |
| 8 | Pressure | 32 | 30 | 27 | 44 | 40 | 36 |
| 9 | Pressure | 33 | 30 | 27 | 44 | 40 | 36 |
| 10 | Pressure | 34 | 30 | 28 | 44 | 40 | 36 |
| 11 | Pressure | 34 | 30 | 27 | 43 | 40 | 35 |
| 12 | Pressure | 34 | 30 | 27 | 44 | 40 | 35 |
| 13 | Pressure | 33 | 30 | 27 | 44 | 40 | 35 |
| 14 | Pressure | 33 | 30 | 27 | 44 | 40 | 35 |
| 15 | Pressure | 33 | 30 | 27 | 44 | 40 | 35 |
| 16 | Pressure | 33 | 30 | 27 | 44 | 40 | 35 |
| 17 | Pressure | 33 | 30 | 27 | 44 | 40 | 35 |
| 18 | Pressure | 33 | 30 | 27 | 44 | 40 | 35 |
| 19 | Pressure | 33 | 30 | 27 | 44 | 40 | 35 |
| 20 | Pressure | 34 | 30 | 27 | 44 | 40 | 35 |
| 21 | Pressure | 33 | 30 | 27 | 44 | 40 | 35 |
| 22 | Pressure | | | | | | |
| 23 | Pressure | | | | | | |
| 24 | Pressure | | | | | | |
| 25 | Pressure | | | | | | |
| 26 | Pressure | | | | | | |

FIG. 4

| Weight in grams-Resin Cartridges in a Pressurized Chamber | | | | | | | | |
|---|---|---|---|---|---|---|---|---|
| | | | | | | | | |
| | Test 210 | Test 211 | Test 212 | Test 213 | Test 214 | Test 215 | Test 216 | |
| | 30 PSI | 30 PSI | 30 PSI | 40 PSI | 40 PSI | 40 PSI | Control | |
| | HOT | AMB | COLD | HOT | AMB | COLD | AMB | |
| Start | 677.90 | 678.08 | 674.56 | 676.56 | 675.26 | 675.82 | 675.00 | Week 0 |
| Week 1 | 678.05 | 678.02 | 674.62 | 676.60 | 675.24 | 675.94 | 674.34 | 1 |
| Week 2 | 678.10 | 678.16 | 674.60 | 676.54 | 675.26 | 675.84 | 673.94 | 2 |
| Week 3 | 677.95 | 678.06 | 674.64 | 676.56 | 675.24 | 675.86 | 673.54 | 3 |
| Week 4 | 677.83 | 677.94 | 674.58 | 676.40 | 675.12 | 675.88 | 673.10 | 4 |
| Week 5 | 677.70 | 677.86 | 674.44 | 676.44 | 675.18 | 675.82 | 672.86 | 5 |
| Week 6 | 677.60 | 677.86 | 674.46 | 676.14 | 675.14 | 675.66 | 672.38 | 6 |
| Week 7 | 677.60 | 677.78 | 674.38 | 676.28 | 675.08 | 675.78 | 671.72 | 7 |
| Week 8 | 677.60 | 677.68 | 674.42 | 676.10 | 675.04 | 675.78 | 671.24 | 8 |
| Week 9 | 677.63 | 677.76 | 674.40 | 676.06 | 675.02 | 675.72 | 670.92 | 9 |
| Week 10 | 677.55 | 677.84 | 674.40 | 675.94 | 675.04 | 675.64 | 670.45 | 10 |
| Week 11 | 677.50 | 677.74 | 674.32 | 676.20 | 675.04 | 675.70 | 669.98 | 11 |
| Week 12 | 677.38 | 677.70 | 674.26 | 676.12 | 674.96 | 675.66 | 669.48 | 12 |
| Week 13 | 677.40 | 677.54 | 674.28 | 676.26 | 674.92 | 675.60 | 669.04 | 13 |
| Week 14 | 677.45 | 677.70 | 674.24 | 676.22 | 674.94 | 675.62 | 667.40 | 14 |
| Week 16 | 677.58 | 677.70 | 674.34 | 676.38 | 675.00 | 675.60 | 666.28 | 16 |

FIG. 8a

| Cumulative Weight Loss in grams -Resin Cartridges in a Pressurized Chamber | | | | | | | | |
|---|---|---|---|---|---|---|---|---|
| | | | | | | | | |
| | Test 210 | Test 211 | Test 212 | Test 213 | Test 214 | Test 215 | Test 216 | |
| | 30 PSI | 30 PSI | 30 PSI | 40 PSI | 40 PSI | 40 PSI | Control | |
| | HOT | AMB | COLD | HOT | AMB | COLD | AMB | |
| Start | 0.00 | 0.00 | 0.00 | 0.00 | 0.00 | 0.00 | 0.00 | Week 0 |
| Week 1 | -0.15 | 0.06 | -0.06 | -0.04 | 0.02 | -0.12 | 0.66 | 1 |
| Week 2 | -0.20 | -0.08 | -0.04 | 0.02 | 0.00 | -0.02 | 1.06 | 2 |
| Week 3 | -0.05 | 0.02 | -0.08 | 0.00 | 0.02 | -0.04 | 1.46 | 3 |
| Week 4 | 0.07 | 0.14 | -0.02 | 0.16 | 0.14 | -006 | 1.90 | 4 |
| Week 5 | 0.20 | 0.22 | 0.12 | 0.12 | 0.08 | 0.00 | 2.14 | 5 |
| Week 6 | 0.30 | 0.22 | 0.10 | 0.42 | 0.12 | 0.16 | 2.62 | 6 |
| Week 7 | 0.30 | 0.30 | 0.18 | 0.28 | 0.18 | 0.04 | 3.28 | 7 |
| Week 8 | 0.30 | 0.40 | 0.14 | 0.46 | 0.22 | 0.04 | 3.76 | 8 |
| Week 9 | 0.27 | 0.32 | 0.16 | 0.50 | 0.24 | 0.10 | 4.08 | 9 |
| Week 10 | 0.35 | 0.24 | 0.16 | 0.62 | 0.22 | 0.18 | 4.55 | 10 |
| Week 11 | 0.40 | 0.34 | 0.24 | 0.36 | 0.22 | 0.12 | 5.02 | 11 |
| Week 12 | 0.52 | 0.38 | 0.30 | 0.44 | 0.30 | 0.16 | 5.52 | 12 |
| Week 13 | 0.50 | 0.54 | 0.28 | 0.30 | 0.34 | 0.22 | 5.96 | 13 |
| Week 14 | 0.45 | 0.38 | 0.32 | 0.34 | 0.32 | 0.20 | 7.60 | 14 |
| Week 16 | 0.32 | 0.38 | 0.22 | 0.18 | 0.26 | 0.22 | 8.72 | 16 |

FIG. 8b

| Pressure Change -Resin Cartridges Stored in a Pressurized Chamber Firmness Tester Values in Pounds of Force to Dimple 0.150"-2 Hours after Opening | | | | | | | | |
|---|---|---|---|---|---|---|---|---|
| | | | | | | | | |
| | Test 210 | Test 211 | Test 212 | Test 213 | Test 214 | Test 215 | Test 216 | |
| | 30 PSI | 30 PSI | 30 PSI | 40 PSI | 40 PSI | 40 PSI | Control | |
| | HOT | AMB | COLD | HOT | AMB | COLD | AMB | |
| Start | 3.93 | 3.86 | 3.86 | 3.86 | 3.89 | 3.90 | 3.86 | Week 0 |
| Week 1 | 4.19 | 3.97 | 3.85 | 4.24 | 3.81 | 3.82 | 3.21 | 1 |
| Week 2 | 3.62 | 3.66 | 3.77 | 4.03 | 3.69 | 3.56 | 3.01 | 2 |
| Week 3 | 3.41 | 3.45 | 3.70 | 4.00 | 3.96 | 3.69 | 2.78 | 3 |
| Week 4 | 3.14 | 3.34 | 3.73 | 3.68 | 3.71 | 3.71 | 2.57 | 4 |
| Week 5 | 3.03 | 3.01 | 3.53 | 3.53 | 3.41 | 3.34 | 2.27 | 5 |
| Week 6 | 2.93 | 3.08 | 3.59 | 3.44 | 3.50 | 3.67 | 2.11 | 6 |
| Week 7 | 2.64 | 3.04 | 3.39 | 3.33 | 3.35 | 3.40 | 1.84 | 7 |
| Week 8 | 2.66 | 3.00 | 3.35 | 3.03 | 3.34 | 3.29 | 1.71 | 8 |
| Week 9 | 2.46 | 2.89 | 3.25 | 2.76 | 3.26 | 3.34 | 1.52 | 9 |
| Week 10 | 2.39 | 2.69 | 3.20 | 2.84 | 3.31 | 3.41 | 1.32 | 10 |
| Week 11 | 2.24 | 2.94 | 3.16 | 2.92 | 3.23 | 3.35 | 1.11 | 11 |
| Week 12 | 2.27 | 2.77 | 2.91 | 3.04 | 3.05 | 3.25 | 0.89 | 12 |
| Week 13 | 2.16 | 2.77 | 2.84 | 2.94 | 3.07 | 3.14 | 0.67 | 13 |
| Week 14 | 2.29 | 2.75 | 2.96 | 2.96 | 2.78 | 3.15 | 0.69 | 14 |
| Week 16 | 2.44 | 2.38 | 2.74 | 3.23 | 2.88 | 2.93 | 0.39 | 16 |

FIG. 8c

| Pressure Change -Resin Cartridges Stored in a Pressurized Chamber Internal Cartridge Pressure in PSI-2 Hours after Opening | | | | | | | | |
|---|---|---|---|---|---|---|---|---|
| | | | | | | | | |
| | Test 210 | Test 211 | Test 212 | Test 213 | Test 214 | Test 215 | Test 216 | |
| | 30 PSI | 30 PSI | 30 PSI | 40 PSI | 40 PSI | 40 PSI | Control | |
| | HOT | AMB | COLD | HOT | AMB | COLD | AMB | |
| Start | 26.50 | 26.10 | 26.09 | 26.08 | 26.26 | 26.29 | 26.11 | Week 0 |
| Week 1 | 27.95 | 26.70 | 26.03 | 28.24 | 25.81 | 25.86 | 22.34 | 1 |
| Week 2 | 24.70 | 24.96 | 25.59 | 27.06 | 25.09 | 24.35 | 21.22 | 2 |
| Week 3 | 23.49 | 23.72 | 25.19 | 26.87 | 26.67 | 25.12 | 19.91 | 3 |
| Week 4 | 21.95 | 23.11 | 25.35 | 25.06 | 25.24 | 25.24 | 18.70 | 4 |
| Week 5 | 21.36 | 21.24 | 24.22 | 24.22 | 23.51 | 23.12 | 16.97 | 5 |
| Week 6 | 20.75 | 21.62 | 24.53 | 23.68 | 24.00 | 2501 | 16.09 | 6 |
| Week 7 | 19.11 | 21.39 | 23.42 | 23.05 | 23.19 | 23.44 | 14.54 | 7 |
| Week 8 | 19.19 | 21.16 | 23.19 | 21.33 | 23.12 | 22.85 | 13.77 | 8 |
| Week 9 | 18.08 | 20.51 | 22.59 | 19.79 | 22.67 | 23.11 | 12.70 | 9 |
| Week 10 | 17.68 | 19.40 | 22.31 | 20.24 | 22.91 | 23.51 | 11.53 | 10 |
| Week 11 | 16.81 | 20.82 | 22.09 | 20.71 | 22.47 | 23.18 | 10.37 | 11 |
| Week 12 | 16.97 | 19.82 | 20.67 | 21.37 | 21.43 | 22.62 | 9.07 | 12 |
| Week 13 | 16.34 | 19.87 | 20.27 | 20.82 | 21.55 | 21.98 | 7.82 | 13 |
| Week 14 | 17.08 | 19.73 | 20.95 | 20.91 | 19.88 | 22.03 | 7.95 | 14 |
| Week 16 | 17.94 | 17.62 | 19.70 | 22.48 | 20.48 | 20.74 | 6.19 | 16 |

FIG. 8d

METHOD FOR PRESERVING THE FIRMNESS AND INTERNAL PRESSURE OF A RESIN CARTRIDGE AND IMPROVING THE SHELF-LIFE OF A RESIN CARTRIDGE

RELATED APPLICATIONS

This application claims the benefit of U.S. Provisional Application Ser. No. 61/392,773, filed on Oct. 13, 2010, which is incorporated herein by reference.

BACKGROUND

1. Field of the Disclosure

A method is provided which comprises storing resin cartridges in a pressurized environment. A preferred method is to store the resin cartridges in a pressurized container designed to contain singular or multiple resin cartridges, or packs of resin cartridges, and this container will double as a shipping container. The pressurized shipping and storage container slows or completely arrests the process that contributes to "limp" or depressurized resin cartridges, thus extending the shelf life of the resin cartridges. A secondary method is to store resin cartridges in a pressurized environment designed to hold multiple resin cartridges specifically to enhance the internal pressure. Thus a cartridge with lesser pressure can be modified so it now has more pressure.

2. Discussion of the Background Art

Anchor bolts are employed in various fields of engineering, for example, as strengthening or reinforcing members in rock formations and in structural bodies. The bolts are inserted into drill holes in the formation or body, and often are fixed or anchored, at their inner end or over substantially their entire length, by means of a reactive grouting composition that hardens around the bolt. When used in a mine roof, bolts grouted in this manner help significantly to prevent mine roof failure.

A reactive grouting composition can contain a resin and catalyst. Such a reactive grouting composition is typically placed in a two compartment tubular shell and is referred to as a resin cartridge. The resin cartridge should be held rigid by the internal package pressure that is created by a cartridge packaging machine when end clips are applied to the cartridge film to seal the contents.

However, within a short period of time from several weeks to several months, the cartridges become limp or lacking in stiffness or firmness. Such limp cartridges are a problem for the customer because limp cartridges are difficult to insert into overhead boreholes. It was found that one cause of the limpness was water permeating through the film and through the end clips. For example, a PET (polyethylene terephthalate) film is used throughout the industry because of its high modulus of elasticity. But a potential drawback of a PET film is a high water vapor transmission rate. Thus, any resin cartridge containing PET film as a shell, and water as a component, is subject to limpness due to loss of water volume. Reactive grouting compositions utilizing water are described in U.S. Pat. No. 4,280,943. It was also found that a second cause of limpness is expansion or creep of the PET film due to stresses created from pressurizing the contents of the resin cartridge. Creep is a permanent dimensional change in the film that comprises the shell from prolonged stress or a combination of stress and elevated temperature. The expansion or creep of the PET film reduces the internal pressure by increasing the internal volume of the resin cartridge.

Solutions that reduce water loss by covering the PET film with a barrier coating such as PVdC (Polyvinylidene chloride) or a metalized (metal impregnated) PET film work well and have been employed to reduce water loss. However, such solutions can be expensive and potentially can create problems in manufacturing resin cartridges. These solutions also do not help with the expansion of the cartridge due to PET film creep. Therefore, there is an increasing need to develop a solution that can retain the firmness or stiffness of the resin cartridge for a reasonable period time and at reasonable cost.

Resin cartridges are known to develop cosmetic defects with time. Primary among these cosmetic defects is the "limp" resin cartridge. Resin cartridges are typically manufactured with internal pressure and this internal pressure gives the package and its contents a rigidity that lends itself to easier use by the customer. A limp resin cartridge is a cartridge that has lost some or all of its internal pressure. Limp resin cartridges can be difficult to use in the mining environment. The present disclosure overcomes the disadvantages of the limp resin cartridges, by reducing the occurrence of limp resin cartridges and extending the shelf-life of the product via the novel concept of storing the resin cartridges in a pressurized environment until time of consumption. The present disclosure also describes a method to increase the internal pressure of a resin cartridge that has lost some or all of its internal pressure by storage in a pressurized environment.

The present disclosure provides many advantages, which shall become apparent as described below.

SUMMARY

A composition that can be used as a reactive grouting composition is provided. The composition comprises a first component, and a second component. The first component is a catalyst. The first component can be composed of one, several or all of the following: a peroxide, a liquid that comprises water, glycol, oil, plasticizer or glycerin, solid particulates, a freeze point modifier, and, optionally, a sugar. The second component is a resin mastic. The second component can be composed of one, several or all of the following: a polymer, a solvent, a surfactant, a wetting agent, viscosity modifiers, a cross-linking agent, promoters, inhibitors and solid particulates. The composition is provided in a shell composed of, for example, a thin PET film. The film shell comprises a first and second compartment, such that the first component is in the first compartment and the second component is in the second compartment. The composition and the shell are collectively referred to as a resin cartridge.

A method for preserving the firmness and internal pressure of a resin cartridge. The method involves inserting a catalyst material into a first compartment of a resin cartridge, inserting a resin material into a second compartment of a resin cartridge, pressurizing the first and second compartments, disposing at least one resin cartridge into a container, and pressurizing the container.

A method for regaining firmness and internal pressure in a depressurized resin cartridge. The method involves inserting a catalyst material into a first compartment of a resin cartridge, inserting a resin material into a second compartment of a resin cartridge, pressurizing the first and second compartments to form a pressurized resin cartridge that after a period of time becomes depressurized and forms a depressurized resin cartridge, disposing at least one depressurized resin cartridge into a container, and pressurizing the container.

A method for substantially preserving the firmness and internal pressure of a reactive grouting composition and its shell (collectively known as a resin cartridge) is provided. The process comprises placing the cartridge or cartridges in a pressurized environment. A preferred pressurized environment is a container or canister that can be pressurized and double as a shipping container. The pressurized container creates an artificial environment around the cartridge or cartridges that slows or eliminates the processes that result in "limp" or depressurized cartridges.

An assembly for extending the shelf-life of a pressurized resin cartridge. The assembly includes at least one pressurized resin cartridge comprising a first compartment for holding a catalyst and a second compartment for holding a resin mastic. The assembly has a pressurized container sealingly disposed about the pressurized resin cartridge. Such assembly minimizes depressurization of the pressurized resin cartridge and extends the shelf-life of the pressurized resin cartridge.

An assembly for extending the shelf-life of a depressurized resin cartridge. The assembly includes at least one depressurized resin cartridge comprising a first compartment for holding a catalyst and a second compartment for holding a resin mastic. The assembly has a pressurized container sealingly disposed about the depressurized resin cartridge. Such assembly increases pressurization of the depressurized resin cartridge and extends the shelf-life of the depressurized resin cartridge.

According to one embodiment, a pressurized assembly for preserving the firmness and internal pressure of a resin cartridge, the assembly comprising: at least one resin cartridge comprising a first compartment for holding a catalyst and a second compartment for holding a resin mastic; and a pressurized container sealingly disposed about the resin cartridge, thereby avoiding the depressurization, or "limping" of the resin cartridge and, thus, extending the shelf-life of the resin cartridge. In another embodiment, a pressurized assembly for preserving the firmness and internal pressure of a resin cartridge, the assembly comprising: at least one resin cartridge comprising a first compartment for holding a catalyst and a second compartment for holding a resin mastic; and a pressurized container sealingly disposed about the resin cartridge, thereby increasing the internal pressure of the resin cartridge and, thus, extending the shelf-life of the resin cartridge.

The shell of a resin cartridge is formed of at least one material selected from the group consisting of: a polyethylene terephthalate (PET) film, polyethylene naphthalate (PEN) film, polypropylene (PP) film, or polyethylene (PE) film. The shell of a resin cartridge can also be a composite film containing multilayer structures of core films as listed above with or without layers of barrier or sealing polymers.

The first compartment holds a catalyst. The catalyst can be composed of one, several or all of the following: a peroxide, a liquid that comprises water, glycol, oil, plasticizer or glycerin, solid particulates, a freeze point modifier, and, optionally, a sugar. The second compartment holds a resin mastic. The resin mastic can be composed of one, several or all of the following: a polymer, a solvent, a surfactant, a wetting agent, viscosity modifiers, a cross-linking agent, promoters and inhibitors, and solid particulates.

The internal pressure of the resin cartridge is preferably between about 5 psi to about 25 psi above ambient pressure. The internal pressure of the pressurized container is between about 5 psi above ambient pressure to about 125 psi above ambient pressure. The preferred container pressure is about 5 psi to about 60 psi above ambient pressure.

A method for preserving the firmness and internal pressure of a resin cartridge, or raising the internal pressure of a resin cartridge to increase firmness, the method comprising: inserting a catalyst into a first compartment of a resin cartridge; inserting a resin mastic into a second compartment of a resin cartridge; pressurizing the first and second compartments; disposing at least one resin cartridge into a pressurized container; and pressurizing the container.

A method for extending the shelf-life of a pressurized resin cartridge. The method involves providing at least one pressurized resin cartridge comprising a first compartment for holding a catalyst and a second compartment for holding a resin mastic. The pressurized resin cartridge is sealingly disposed in a container, and the container is pressurized. The method thereby minimizes depressurization of the pressurized resin cartridge and extends the shelf-life of the pressurized resin cartridge.

A method for extending the shelf-life of a depressurized resin cartridge. The method involves providing at least one depressurized resin cartridge comprising a first compartment for holding a catalyst and a second compartment for holding a resin mastic. The depressurized resin cartridge is sealingly disposed in a container and the container is pressurized. The method thereby increases pressurization of the depressurized resin cartridge and extends the shelf-life of the depressurized resin cartridge.

An apparatus for determining firmness of a resin cartridge. The apparatus includes a trough for holding the resin cartridge in a stable position, and a force indicator for creating a depression of predetermined depth on the resin cartridge. A pounds-force reading is obtained from the force indicator at the predetermined depth and the pounds-force reading is converted to resin cartridge internal psi (pounds per square inch).

A resin cartridge having a high initial firmness and a high initial internal pressure resulting from improved quantification of initial firmness in the resin cartridge production process, yet retains diameter and length requirements sufficient to fit inside a borehole in a mine or tunnel, maintains operational compatibility with mechanisms and machinery used to fit the resin cartridge inside the borehole, and has a volume that meets ASTM F432 minimum volume specifications.

A resin cartridge having a high initial firmness and a high initial internal pressure, and a diameter and length, sufficient to fit inside a borehole in a mine or tunnel. The resin cartridge is operationally compatible with mechanisms and machinery used to fit the resin cartridge inside the borehole. The resin cartridge has a volume that meets ASTM F432 minimum volume specifications.

A method for preparing a resin cartridge having high initial firmness and high initial internal pressure resulting from improved quantification of initial firmness in the resin cartridge production process, yet retains diameter and length requirements sufficient to fit inside a borehole in a mine or tunnel, and maintains operational compatibility with mechanisms and machinery used to fit the resin cartridge inside the borehole. The method involves inserting a catalyst into a first compartment of a resin cartridge and inserting a resin mastic into a second compartment of a resin cartridge, such that the resin cartridge has a high firmness and high internal pressure, yet retains diameter and length requirements sufficient to fit inside a borehole in a mine or tunnel, maintains operational compatibility with mechanisms and machinery used to fit the resin cartridge inside the borehole, and has a volume sufficient that meets ASTM F432 minimum volume specifications. The method preferably uses the resin cartridge firmness testing apparatus of this disclosure to accurately measure the firmness of the resin cartridge. By using the resin cartridge firmness testing apparatus in this method, resin cartridges can be consistently produced with high initial firmness and high internal pressure. This method produces resin cartridges for shipping and storage in a pressurized assembly of this disclosure for extending the shelf life of a resin.

A method for preparing a resin cartridge that comprises inserting a catalyst material into a first compartment of a resin cartridge; and inserting a resin material into a second compartment of said resin cartridge. The resin cartridge has a high initial firmness and a high initial internal pressure, and a diameter and length, sufficient to fit inside a borehole in a mine or tunnel. The resin cartridge is operationally compatible with mechanisms and machinery used to fit the resin cartridge inside the borehole. The resin cartridge has a volume that meets ASTM F432 minimum volume specifications.

Further objects, features and advantages of the present disclosure will be understood by reference to the following drawings and detailed description.

BRIEF DESCRIPTION OF THE DRAWINGS

FIG. 4 depicts a chart of daily pressure logs for selected pressure vessels.

FIG. 8*a* depicts a chart summarizing resin cartridge weights in grams over time disposed in a pressurized chamber according to the present disclosure for various test vessels of FIG. 4.

FIG. 8*b* depicts a chart summarizing cumulative weight loss in grams over time of resin cartridges disposed in a pressurized chamber according to the present disclosure for various test vessels of FIG. 4.

FIG. 8*c* depicts a chart summarizing pressure change in resin cartridges disposed in a pressurized chamber after pressure normalizes (+2 hours) according to the present disclosure for various test vessels of FIG. 4.

FIG. 8*d* depicts a chart summarizing the corresponding internal pressure of the resin cartridges over time calculated from the firmness testing machine value in FIG. 8*c*.

DETAILED DESCRIPTION OF THE PREFERRED EMBODIMENT

As used herein, the term "depressurized resin cartridge" refers to any resin cartridge having insufficient pressure to give it stiffness or firmness needed for mining operations, e.g., capable of easily being inserted into overhead boreholes in mines. In an embodiment of this disclosure, an assembly for extending the shelf-life of a resin cartridge can increase pressurization of a depressurized resin cartridge and, thus, extend the shelf-life of the depressurized resin cartridge.

A resin cartridge is composed of a reactive grouting composition, and a shell to contain the reactive grouting composition. The reactive grouting composition comprises a first component and a second component. The first component is a catalyst. The first component can be composed of one, several or all of the following: a peroxide, a liquid that comprises water, glycol, oil, plasticizer or glycerin, solid particulates, a freeze point modifier, and, optionally, a sugar. The second component is a resin mastic. The second component can be composed of one, several or all of the following: a polymer, a solvent, a surfactant, a wetting agent, viscosity modifiers, a cross-linking agent, promoters and inhibitors, and solid particulates.

Figure 1:
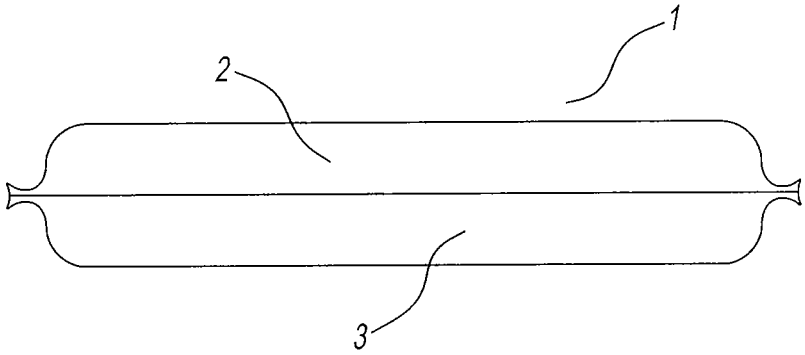
FIG. 1 depicts a resin cartridge according to the present disclosure.

As shown in FIG. 1, the shell is generally composed partially of, or entirely of, a thin PET film, PEN film, PP film, or PE film. The shell of a resin cartridge can also be a composite film containing multilayer structures of two or more of these films. First component (e.g., catalyst) and second component (e.g., resin mastic) are designed to react with each other and form a solid state when mixed with each other under suitable conditions. The shell of PET film is compartmentalized so that the first component is isolated in, for example, a first catalyst section or compartment 2 and the second component is isolated in a second resin mastic section or compartment 3. The reactive grouting compositions and the PET shell are collectively referred to as resin cartridge 1.

Figure 2:
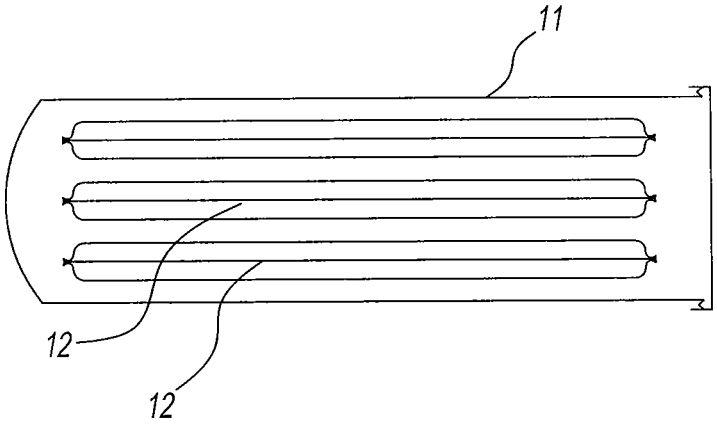
FIG. 2 depicts a pressurized container with a plurality of resin cartridge of FIG. 1 disposed therein according to the present disclosure.
Figure 3:
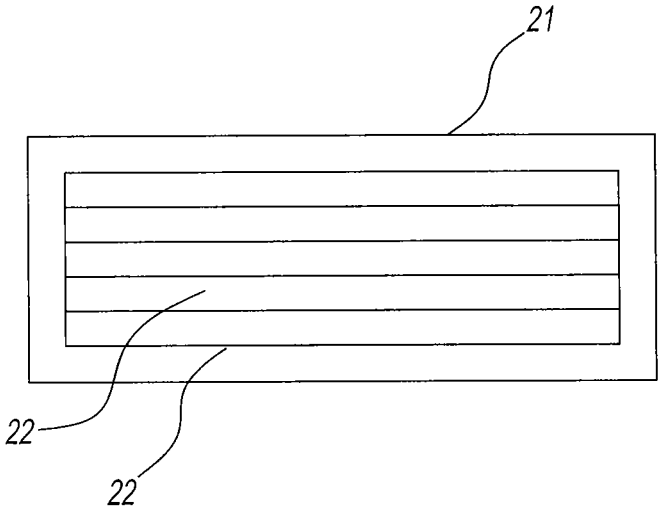
FIG. 3 depicts a bulk pressurized container according to another embodiment of the present disclosure.

Alternatively, a pressurized container 11 can be designed to hold a plurality of resin cartridges 12, as shown in FIG. 2. In addition, FIG. 3 shows another embodiment wherein individual boxes or bundles of resin cartridges 22 can be disposed within a bulk pressurized container 21.

The first and second components of resin cartridge 1 generally remain isolated in their separate compartments (2, 3) in the PET film up to the time of use. The use of resin cartridge 1 typically involves creating a borehole by drilling into a body, such as rock or concrete. Resin cartridge 1 is loaded into the borehole and then a reinforcing member, typically a steel rod with an irregular surface profile, is forced into the borehole and rotated by hand or mechanical means. As the steel member is forced into the borehole and rotated, the thin PET film ruptures, exposing and mixing component one with component two. The components react with each other and chemically change into a solid state around the reinforcing member, thus fixing the reinforcing member in the borehole.

The pressure found in a typical resin cartridge at the time of manufacture can be significant. Testing has shown that internal pressures of 5 psi to 25 psi (pounds per square inch above ambient pressure) can typically be found through measuring at time of manufacture.

Initial resin cartridge firmness at time of manufacturer is an integral part of the shelf life of the cartridge. Cartridge firmness is directly related to the internal pressure of the contents of the resin cartridge. The shelf life of a cartridge due to loss of firmness is defined as the time it takes the internal pressure of the cartridge to change from its initial value to a value that makes the cartridge too floppy to use. The higher the initial internal cartridge pressure, the longer the time it will take to reach the end of its shelf life. The end of the cartridge shelf life is reached when the internal pressure is approximately 2 to 3 psi. A high internal cartridge pressure is a requirement for maximum cartridge shelf life.

Increasing internal pressure of a resin cartridge to improve firmness has a negative side effect on controlling cartridge diameter. The increased internal pressure will cause a "ballooning" effect on the diameter of the cartridges. The ballooning affect is caused by the pressure induced stresses placed on the tubular film shell and the film seals that create the shell. Resin cartridges typically have a diameter specification of plus or minus 0.02" and a length specification or plus or minus ¼" to meet ASTM F432 minimum volume specifications. A cartridge diameter that is too large could cause issues with resin injection equipment, clearances inside boreholes, and excess consumption of ingredients. Adjustments can be made to diameter sizing fixtures used during the form and filling process of making resin cartridges so that cartridges made with increased firmness would still meet the overall cartridge diameter specifications.

In accordance with this disclosure, the resin cartridges exhibit a volume that meets ASTM F432 minimum volume specifications. The high initial firmness at time of manufacture contributes to improved shelf life of the resin cartridge. The combination of firmness and a diameter specification is preferably sufficient for the resin cartridge to fit inside boreholes and to be operationally compatible with mechanisms and machinery used to fit the resin cartridge inside boreholes. The resin cartridge firmness testing apparatus described herein allows for the production of resin cartridges with a high initial firmness and high initial internal pressure. At the time of manufacture, the resin cartridges of this disclosure have consistent high firmness and high internal pressure which makes it easier for the resin cartridge users to insert the cartridge into a borehole.

ASTM F432 requirements are for volume of a resin cartridge at the time of manufacture. Volume is calculated using diameter and length of the resin cartridge. The diameter and length of a resin cartridge are important they demonstrate the volume necessary to meet ASTM F432 minimum volume specifications. The diameter of a borehole is tightly controlled so that the diameter of a resin cartridge also needs to be tightly controlled. Also, the mechanisms and machinery used to install resin cartridges require a tightly controlled diameter and length for the resin cartridge.

Conventional methods for determining the firmness of a cartridge at time of manufacture were either subjective or did not yield accurate data. One method to determine cartridge firmness is for a packaging machine operator to squeeze the cartridge with his hand and make a subjective decision if the cartridge is above the firmness that he has been trained to make. Each operator could have different criteria for what is acceptable to sell. Another method used in the resin cartridge industry is a "droop" test where the cartridge is supported at one end and a predetermined length of the cartridge is left unsupported. The amount the unsupported end of the cartridge droops provides an indication of the firmness of the cartridge. The "droop" test results can be affected by existing creases in the shell film, the diameter of the cartridge, or the density of the filler. "Droop" test results lack precision and are often not repeatable. Since cartridge firmness is related to the internal pressure of the resin cartridge, an accurate and non-destructive method was needed for measuring the internal pressure of the cartridge. In accordance with this disclosure, an improved measurement tool is incorporated in the manufacturing process, allowing operators to have a quantitative value of the firmness of a resin cartridge.

A firmness testing machine was specifically developed to accurately measure the force necessary to create a depression in the side wall of a resin cartridge. Since a resin cartridge has internal pressure and the thin film composing the shell is flexible, a correlation between pounds-force (the resistance to create the depression) and internal pressure can be established. The resin cartridge is typically tested (the depression is formed) at a point midway between the ends of the cartridge and at a spot midway between the seals that run opposite to each other and along the long axis of the resin cartridge. The firmness testing machine is designed with a trough to hold the resin cartridge in a stable position while a force indicator, by way of a "T" shaped probe, creates a depression of a known depth.

The depth of the depression is measured by way of a dial indicator reading to an accuracy of 0.001 inches and is attached directly to the force indicator and probe. The readout on the force indicator is in pounds-force and is accurate to 0.01 pounds. A typical range of readings generated in this manner will vary from a low of 0.50 pounds-force to create a 0.150 inch depression in the sidewall of a resin cartridge to a high of 5.00 pounds-force to create a 0.150 inch depression the sidewall of a resin cartridge.

The pounds-force reading to create a depression of known depth can be converted to an internal psi (pounds per square inch) reading as described hereinbelow. A resin cartridge is prepared by severing one end of the cartridge and attaching an air tight manifold that in turn can be attached to a hand pump with a pressure indicator that reads gage pressure in psi (pounds per square inch). The resin cartridge is mounted in the firmness testing machine and a known psi reading is given to the cartridge by way of the hand pump, as read on the pressure indicator. The firmness testing machine is then used to create a depression in the sidewall of the resin cartridge as previously described. With this methodology, a correlation between pounds-force (to create a depression of known depth) and gage pressure psi (pound per square inch) as read on the pressure indicator can be established. A range of internal pressures can then be applied to the cartridge by way of the hand pump and a range of pounds-force readings can be correlated to the psi readings. The correlation of external pounds-force (to create the depression of known depth) to internal psi (as read on the pressure indicator) is as follows in Table 1.

TABLE 1

| | Internal cartridge pressure in pounds per square inch | | | | | | | | | | | | |
|---|---|---|---|---|---|---|---|---|---|---|---|---|---|
| | 5 | 7 | 10 | 11 | 12 | 13 | 14 | 15 | 16 | 17 | 19 | 20 | 25 |
| Firmness tester reading in pounds-force | 1.57 | 1.95 | 2.45 | 2.60 | 2.79 | 3.01 | 3.06 | 3.23 | 3.32 | 3.78 | 3.91 | 4.19 | 5.13 |

With this correlation, the internal psi reading on any cartridge can be estimated by taking a pound-force reading by way of the firmness testing machine. This is a highly desirable way to determine the internal psi reading of a resin cartridge since attempting to take a direct psi reading of a resin cartridge is impractical and would most likely result in a ruptured resin cartridge.

The resin cartridge firmness testing apparatus gives precise firmness readings at the time of manufacture. The apparatus helps maintain high initial firmness by helping establish a standard that all production resin cartridges must pass.

In an embodiment, the cartridge firmness testing machine can be an in-line test as the cartridges are being manufactured. Another embodiment of the cartridge firmness testing machine would be a stand-alone unit that would measure resin cartridges after being manufactured.

The ability to accurately measure a resin cartridge firmness value allows the consistent production of a minimum level of resin cartridge firmness. The cartridge firmness testing machine can signal the operator with a light or audible device when the machine is no longer making cartridges to a level of firmness that is acceptable. A quantitative value of the cartridge firmness at time of manufacture allows for the use a resin firmness specification value.

Advantages resulting from the resin cartridge firmness testing machine include, for example, laboratory versions of the cartridge firmness testing machine that can accurately indicate internal cartridge pressure, production versions of the cartridge firmness testing machine that give a firmness value at time of manufacture, a minimum manufacturing specification for resin cartridge firmness based on the resin firmness testing machine value, an alarm when minimum cartridge firmness value is not maintained so correction can be made, and resin cartridges with high initial firmness that can be coupled with shelf life extending methods such as pressurized shipping and storage for improving resin shelf life.

The resin cartridge firmness testing machine of this disclosure allows for the production of resin cartridges with a high initial firmness and high initial internal pressure by accurately measuring the firmness of a resin cartridge. A manufacturing process that uses data from the resin cartridge firmness testing machine can consistently produce resin cartridges with high initial firmness and high internal pressure. With accurate data generated from the resin cartridge firmness testing machine, resin cartridges can be prepared for shipping and storage in a pressurized assembly for extending the shelf life of a resin. The process of this disclosure produces resin cartridges for immediate use within about 5 to about 60 days after manufacture, or for shipping and storage in a pressurized assembly of this disclosure for extending the shelf life of a resin.

Preferably, in the production of resin cartridges, the resin cartridges meet a minimum standard for initial firmness and a target for acceptable diameter. Production equipment such as sizing rings can aid operators in meeting resin cartridge minimum standards for initial firmness and target for acceptable diameter. The resin cartridges of this disclosure have high initial firmness and high initial internal pressure that results in part from the resin cartridge firmness testing apparatus used in the process of this disclosure. In particular, the resin cartridge production process has better quantification of initial firmness, diameter and length requirements are retained so the resin cartridges can fit inside boreholes, and the resin cartridges maintain compatibility with existing mechanisms and machinery used to install the resin cartridges. Further, the resin cartridge production process of this disclosure produces resin cartridges having a volume that meets ASTM F432 minimum volume specifications.

Calculating the internal pressure in a resin cartridge is a vital step in developing solutions for the processes that result in a "limp" or depressurized cartridge. Water vapor migration through the film is well understood in the pressure vessel industry, but the second major contributor to cartridge limpness, film creep, is much less understood. To determine the effect of film creep on the limpness of any resin cartridge, the internal pressure must first be understood, and the processes described above provide this understanding. In addition to the internal pressure, the properties of the film must be determined. Most film providers develop and publish this information, and if they do not, there are a multitude of established laboratories that can measure film creep over time and in different environments.

The effect of film creep on the limpness of a resin cartridge involves calculating the stress in a thin walled tube or cylinder. A resin cartridge, in its entirety, is essentially a thin wall tube that is sealed on both ends by way of a clipping apparatus, and the reactive grouting composition completely fills the tube and applies pressure to the wall of tube. The formulas to calculate the stress in a thin wall tube or cylinder are available in the pressure vessel industry. These formulas are collectively known as "stress determination formulas for thin walled spheres and cylinders".

Using the estimated internal pressure of a resin cartridge, the properties of the film that comprises the shell, and the stress determination formulas for a thin walled cylinder, it was discovered that the stress created in the film by pressuring a resin cartridge exceeds the value that will induce creep or expansion of the film. In cases where the internal pressures of a resin cartridge approach 25 psi (a desirable state for the manufacture of resin cartridges) the stress in the film can greatly exceed the value that will induce creep or expansion of the film.

Given that water vapor migration through the film of a resin cartridge, and film creep of a resin cartridge as a reaction to internal pressure, are both major contributors to the depressurization of a resin cartridge over time, it has become very desirable to develop a solution that can address both issues simultaneously. In accordance with this disclosure, it has been determined that storage of resin cartridges in a pressurized environment affects the two main issues that contribute to limpness of a resin cartridge in the following ways.

Storage of resin cartridges in a pressurized environment affects water vapor and gas migration through the film by slowing or arresting the process that cause water vapor and gas to migrate. Water vapor and gas tends to migrate from an area of high pressure and high concentration (inside the cartridge) to an area of lower pressure and lower concentration (the atmosphere). But when stored in a closed pressurized environment (such as a container), the concentration of water vapor outside the cartridge (but inside the container) quickly reaches saturation and equals the concentration of water vapor inside the cartridge, assuming that water vapor cannot migrate through the wall of the pressurized container. Also, the concentration of water vapor inside the pressurized container can be enhanced by introducing a free water source such as a wet sponge before sealing the container. Also, when stored in a pressurized environment, the pressure outside the cartridge (but inside the container) can be increased to match the pressure inside the resin cartridge. At this point the forces that cause water vapor migration from inside the cartridge to the outside environment theoretically should cease, and laboratory tests demonstrate this fact by measuring the mass loss of a resin cartridge stored in a closed pressurized environment, as opposed to a control cartridge stored in normal atmospheric pressure.

Since water vapor and gas migration from inside the resin cartridge to the outside environment decreases the total volume of material in a resin cartridge, the reduction of water vapor and gas migration from inside the resin cartridge to the outside environment will preserve the volume of material inside the resin cartridge and preserve the firmness of a resin cartridge.

Water vapor and gas migration can be reversed by increasing the pressure outside the resin cartridge (but inside the container) so that the pressure exceeds the pressure inside the resin cartridge. At this point water vapor and gas will migrate from the container to the inside of the resin cartridge. Forced water vapor and air migration from the container to the inside of the resin cartridge can increase the mass and pressure inside the resin cartridge thus a method was obtained to re-pressurize a cartridge that had lost some or all of its internal pressure. Table 2 contains test data that shows the advantages of reduced water loss by storing the cartridges in a 40 psi pressurized container. Water loss from the resin cartridges is quantified in grams of weight loss.

TABLE 2

| | Water Loss Study of Resin Cartridges at Ambient temperature | | | | | | | | |
|---|---|---|---|---|---|---|---|---|---|
| | Start | Week 1 | Week 2 | Week 3 | Week 4 | Week 5 | Week 6 | Week 7 | Week 8 |
| Weight loss in grams in a 40 psi Pressurized Environment | 0.00 | 0.02 | 0.00 | 0.02 | 0.14 | 0.08 | 0.12 | 0.18 | 0.22 |
| Weight loss in grams in a non-pressurized environment | 0.00 | 0.66 | 1.06 | 1.46 | 1.90 | 2.14 | 2.62 | 3.28 | 3.76 |

Storage of resin cartridges in a pressurized environment affects film creep by minimally compressing the cartridge contents to a lesser volume. Even though the cartridge contents are thought of as non-compressible liquids and solids, there are marginally compressible substances trapped within the boundaries of the cartridge such as, but not limited to, water vapor and gases such as entrained air. The compression of the contents of the resin cartridge by way of storage in a pressurized environment reduces the overall volume of the contents and negates or minimizes the ability of the contents to create stress in the film shell, thus the storage of resin cartridges in a pressurized environment negates or minimizes the stresses in the film so that the stresses now fall below the threshold that will induce creep or expansion of the film.

Laboratory tests to determine the effect of storage of resin cartridges in a pressurized environment bolster this claim by comparing the internal pressure of a test cartridge (stored in a pressurized environment) to the internal pressure a control cartridge (stored under normal atmospheric pressure). All testing of the internal pressure of a resin cartridge is done by way of the firmness testing machine previously described. Table 3 shows a comparative loss in internal resin cartridge pressure with cartridges stored in a 40 psi pressurized environment at ambient temperatures to resin cartridges not stored in a pressurized environment.

TABLE 3

| | Internal Resin Cartridge Pressure in PSI at Ambient Temperature | | | | | | | | |
|---|---|---|---|---|---|---|---|---|---|
| | Start | Week 1 | Week 2 | Week 3 | Week 4 | Week 5 | Week 6 | Week 7 | Week 8 |
| Cartridges stored in a 40 psi Pressurized Environment | 18.3 | 17.8 | 17.1 | 18.7 | 17.3 | 15.5 | 16.0 | 15.2 | 15.1 |
| Cartridges stored in a Non-pressurized Environment | 18.1 | 14.4 | 13.2 | 11.9 | 10.7 | 9.0 | 8.1 | 6.6 | 5.8 |

Further evidence that storage in a pressurized environment reduces the overall volume of the contents of a resin cartridge and negates or minimizes the ability of the contents to create stress in the film shell is that a resin cartridge will go through a "recovery period" under which the internal pressure will "rebound". It has been noted through testing that the internal pressure of a resin cartridge can be relatively low when the resin cartridge is removed from the pressurized container. But after a recovery period of several minutes to several hours the pressure will rebound to a much higher pressure. The length of the recovery period and the amount of pressure that is recovered has been directly correlated to the difference in (initial) internal pressure of a resin cartridge and the pressure inside the pressurizing container.

In general, if the pressure of the pressurizing container exceeds the (initial) internal pressure of the stored resin cartridges by a large value, the recovery period-will be long and the pressure rebound will be large. If the pressure of the pressurizing container exceeds the (initial) internal pressure of the stored resin cartridges by a small value, the recovery period will be short and the pressure rebound will be small. All testing of the internal pressure of a resin cartridge is done by way of the firmness testing machine previously described. Table 4 shows an example the recovery cycle that cartridges go through when they are removed from the pressurized environment. In this test, the resin cartridges had been stored in a pressurized environment for 8 weeks at ambient temperature.

TABLE 4

| Recovery Period-Internal Cartridge Pressure in PSI | First Opened | Open + 1 hour | Open + 2 hours |
|---|---|---|---|
| Cartridges stored in 40 psi Closed Pressurized Environment | 2.2 | 13.8 | 15.1 |

The stored resin cartridges, in a pressurized environment, preferably exhibit the shape of a shipping container that can be pressurized. The pressurized shipping container preferably would be large enough to hold a typical "bundle" of resin cartridges that are customary for the industry. But this concept can also be applied to a pressurized container that holds multiple bundles of resin cartridges, multiples of single resin cartridges, or a solitary resin cartridge. The shape of the ideal pressurized container is preferably round, elliptical or cylindrical, or any of a multitude of geometric shapes that lend themselves to pressurization. The ideal pressurized shipping container could be constructed of plastic, plastic with fibrous reinforcement, plastic with a water impervious layer, paper, paper with fibrous reinforcement, paper with a water impervious layer, metal, or a composite of multiple materials. The container preferably has the ability to maintain pressure, and be transportable, fully loaded with resin cartridges. The container is preferably light, and has minimal material costs.

The pressurizing medium can be any gas or a fluid that lends itself to pressurization. "Air" (typical oxygen, nitrogen mix), nitrogen, carbon dioxide, any inert gas, or water are examples of preferred pressurizing mediums. The ideal pressurizing medium would be low cost, not noxious, not flammable, light weight, and store a minimum of potential energy when pressurized.

The methodology to pressurize a shipping container or a re-pressurization container can be by mechanical means during or after sealing or by chemical means after sealing. A pressurized shipping container or a re-pressurization container can also be obtained by sealing the container in a pressurized room or larger container that has, as an ambient pressure, the intended pressure for the sealed pressurized container. A typical pressurizing mechanism would apply a seal or lid and pressurize the container simultaneously, or pressurize by way of a valve or port after sealing. Pressurizing by chemical means would employ introducing a gas or liquid, in cooled or frozen solid form, before the seal is applied to the vessel. After the seal is formed, the liquid or gas would expand and pressurize the vessel to the desired state.

This pressurized shipping container, used to store and ship resin cartridges to the customer allows one to manufacture product and ship it long distances without fear of customer complaints from limp or depressurized cartridges. The pressurized shipping container allows the manufacturing facility to manufacture large batches of product, in anticipation of sales, with the comfort of having a longer shelf-life. Manufacture of product in large batches has an economic benefit to the company by way of higher production rates and lower waste during production.

The preferred embodiment of a re-pressurization container can be a large cylinder designed to hold multiple cases or pallets of resin cartridges. The cylinder would have a sealable door for convenient placement and removal of material. The cylinder would be coupled to a pressurizing apparatus such as an air compressor or other means. The re-pressurization container would have value in the fact that cartridges with poor internal pressure, and thus not suitable for consumption, can now be re-pressurized and made suitable for consumption. The reduction in the number of cartridges deemed not suitable for consumption would have an obvious economic advantage.

Various modifications and variations of this disclosure will be obvious to a worker skilled in the art and it is to be understood that such modifications and variations are to be included within the purview of this application and the spirit and scope of the claims.

EXAMPLES

Six vessels were constructed from Schedule 40 PVC pipe and Steel fittings to create a chamber that could be pressurized and hold five 28 mm×22 inch "Standard Cartridges". Each vessel was fitted with a pressure gage and port so the vessel could be pressurized with compressed air or other gases or liquids, and the pressure monitored. Three vessels were loaded with five resin cartridges and pressurized to 30 psi, and three chambers were loaded and pressurized to 40 psi. One 30 PSI and one 40 PSI vessel were stored at HOT, AMBIENT and COLD temperatures each. HOT temperature is approximate 100 to 105° F., AMBIENT temperature is approximate 68-72° F., and COLD temperature is 35-37° F. The 40 psi vessels had clear PVC pipe on one end to visually inspect the cartridges between tests.

As a control, five additional cartridges were prepared. The five control cartridges were placed in a standard shipping box with fifteen "dummy" or non-test cartridges and stored at AMBIENT temperature. All of the test cartridges were weighed and pressure tested at the start of the test. On a weekly basis the six pressure vessels were unsealed and the cartridges weighed and pressure tested. Prior to unsealing, the pressure vessels designated for HOT and COLD storage were stored at ambient temperature for a duration of approximately eight hours to allow the cartridges a chance for temperature acclimation. Each cartridge stored in a pressurized environment was weighed and pressure tested immediately after removal from the pressurized environment. In addition each cartridge stored in a pressurized environment was pressure tested at +60 minutes and +120 minutes after removal from the pressurized environment.

The cartridges were then reinstalled in the pressure vessel and the vessel was re-sealed, pressurized and restored to its proper temperature designation. To add humidity, one paper towel soaked with 20 grams of distilled water was added to each vessel, prior to sealing. The five control cartridges were also removed from the standard shipping container, weighed and pressure tested on the same schedule. The five control cartridges were weighed and pressure tested once only, immediately after removal from the standard shipping container.

Each test in this series was given a designation. The designation for the six pressure vessels in this series were 210 through 215. The test designations for each cartridge in each pressure vessel were the series number plus a designation of 1 through 5. The five control cartridges were given test designation 216 dash 1 through 5.

Weights were measured with a mass scale accurate to 0.1 grams. The resin cartridge pressure was measured using the firmness testing machine that measures pounds-force to create a 0.150 inch depression in the cartridge. A reading in grams was obtained from each resin cartridge that was used as the basis to determine weight loss over time. A reading in pounds-force was obtained from each resin cartridge that was used as the basis to determine pressure loss over time. The scale on the firmness testing machine varies from 4.90 pounds-force to indicate a very firm cartridge down to 0.20 pounds-force to indicate a very limp or completely depressurized cartridge. The raw weight and pressure data generated from the five cartridges in each test was averaged. The average was recorded in a chart and the weekly averages were displayed in chart and graph form.

FIG. 4 describes the daily pressures as read from the pressure gage on each of the pressurized vessels designated 210 through 215. The pressure reading is gage pressure and is understood to be above ambient atmospheric pressure. Test 216 was not pressurized and not recorded and was understood to be at ambient atmospheric pressure.

Figure 5:
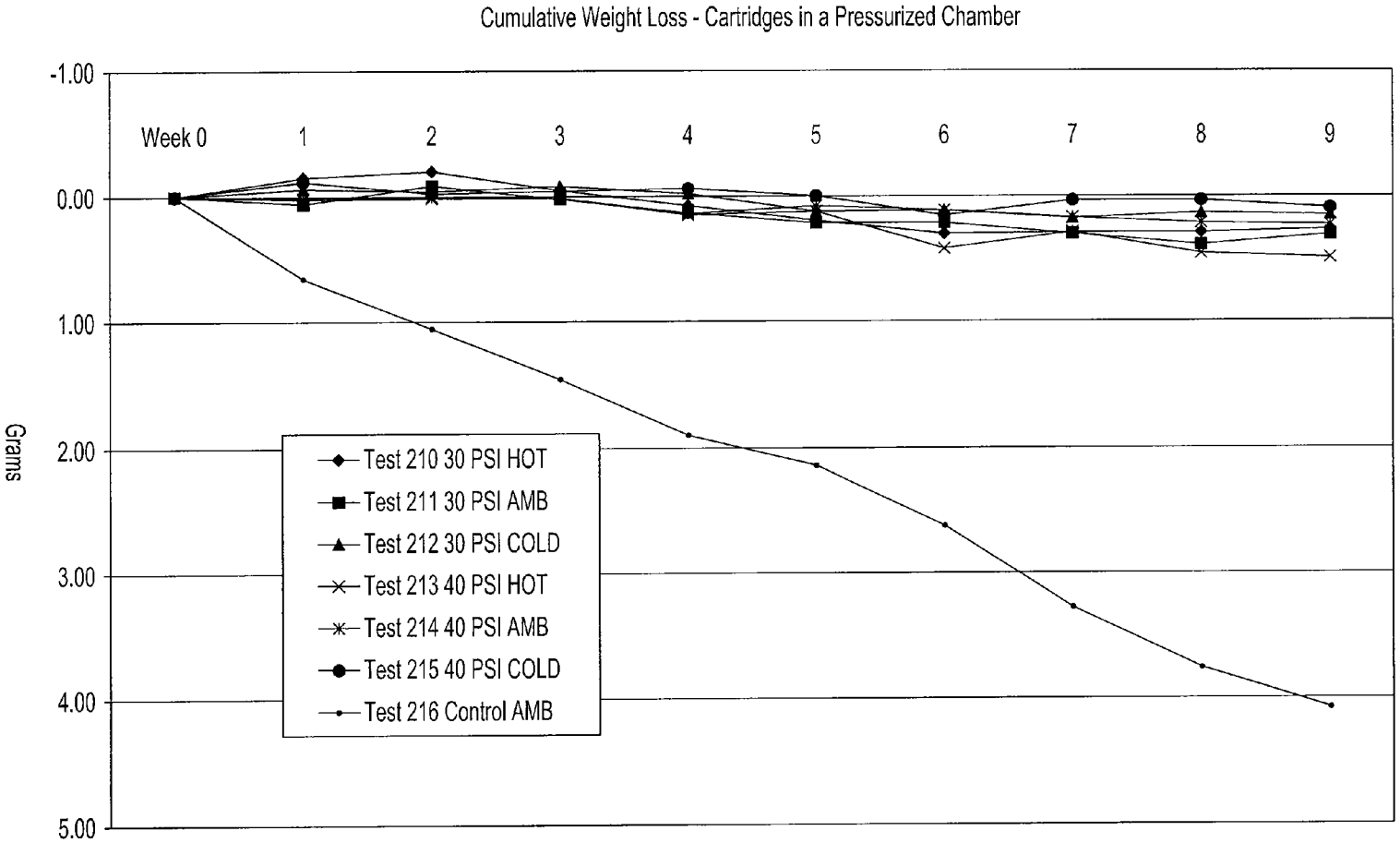
FIG. 5 depicts a graph of cumulative weight loss (in grams) vs. time (in weeks) for resin cartridges in a pressurized chamber for the pressure vessels of FIG. 4.

FIG. 5 describes, in graph form, the cumulative average cartridge weight loss from each pressurized test designated 210 through 215 and non-pressurized control test 216. The X axis is time (in weeks) and the Y axis is mass (in grams). The legend included in the graph indicates the test designation along with the temperature and vessel pressure storage conditions.

Figure 6:
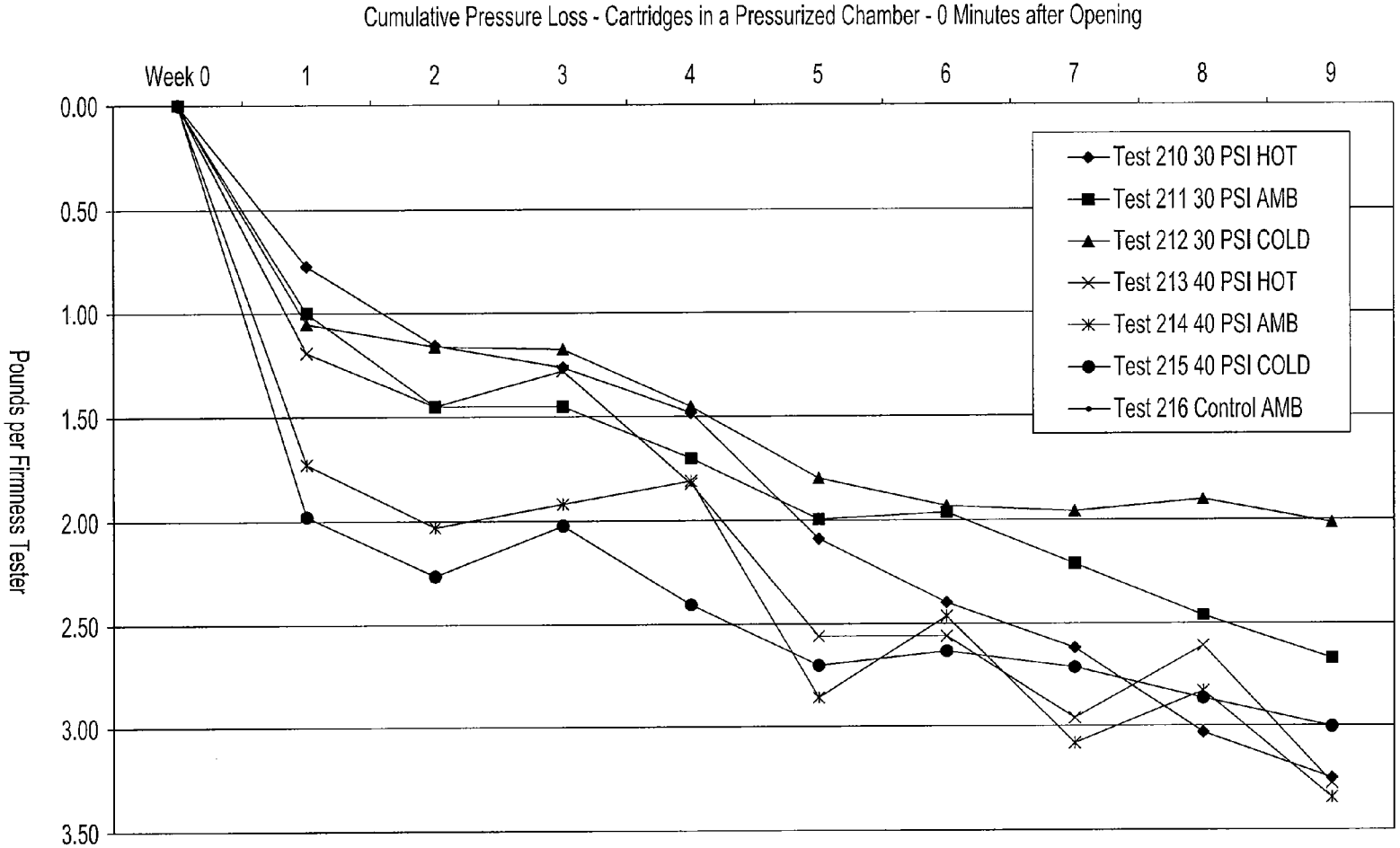
FIG. 6 depicts a graph of cumulative pressure loss (in pounds force per the firmness testing machine) vs. time (in weeks) for resin cartridges in a pressurized chamber (at time of removal) for the pressure vessels of FIG. 4.

FIG. 6 describes, in graph form, the cumulative average cartridge pressure loss from each pressurized test designated 210 through 215 and non-pressurized control test 216. This chart reflects the average cartridge pressure reading taken immediately after removal from the pressurized or non-pressurized environment. The X axis is time (in weeks) and the Y axis is in pounds-force. The legend included in the graph indicates the test designation along with the temperature and vessel pressure storage conditions.

Figure 7:
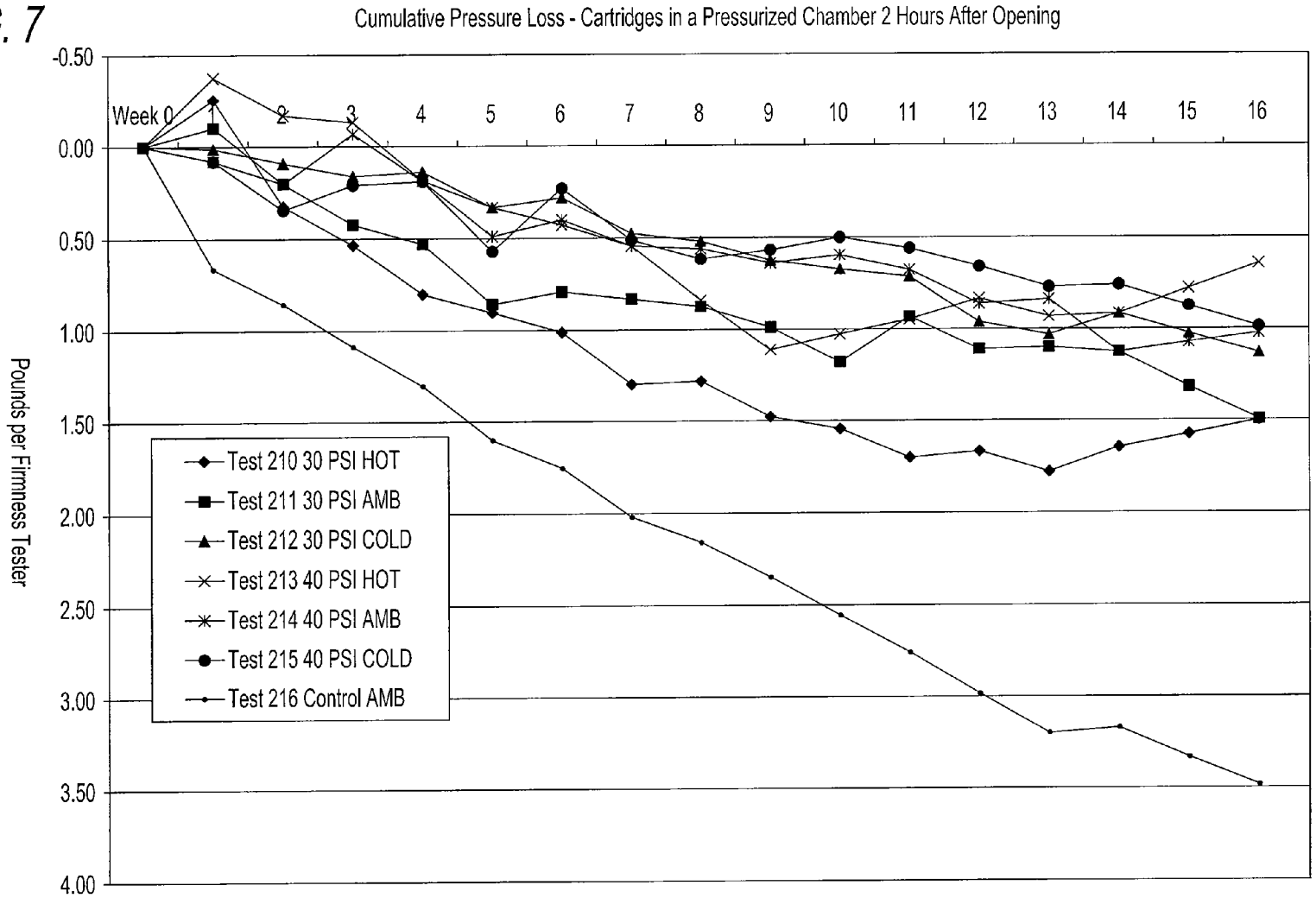
FIG. 7 depicts a graph of cumulative pressure loss (in pounds-force per the firmness testing machine) vs. time (in weeks) for resin cartridges in a pressurized chamber after internal cartridge pressure normalizes 2 hours after removal from the pressure vessels of FIG. 4.

FIG. 7 describes, in graph form, the cumulative average cartridge pressure loss from each pressurized test designated 210 through 215 and non-pressurized control test 216. This chart reflects the average cartridge pressure reading taken 120 minutes after removal from the pressurized environment. The X axis is time (in weeks) and the Y axis is pounds-force. The legend included in the graph indicates the test designation along with the temperature and vessel pressure storage conditions.

FIG. 8*a* depicts, in chart form, the average cartridge weights in grams on a weekly basis from each pressurized test designated 210 through 215 and non-pressurized control test 216, along with the temperature and vessel pressure storage conditions.

FIG. 8*b* depicts, in chart form, the cumulative average cartridge weight loss on a weekly basis from each pressurized test designated 210 through 215 and non-pressurized control test 216, along with the temperature and vessel pressure storage conditions.

FIG. 8*c* depicts, in chart form, the average cartridge pressure measured by the firmness testing machine on a weekly basis from each pressurized test designated 210 through 215 and non-pressurized control test 216, as recorded 2 hours after removal from the pressurized environment along with the temperature and vessel pressure storage conditions.

FIG. 8*d* is a chart summarizing the corresponding internal pressure of the resin cartridges over time calculated from the firmness testing machine values in FIG. 8*c*.

Figure 9:
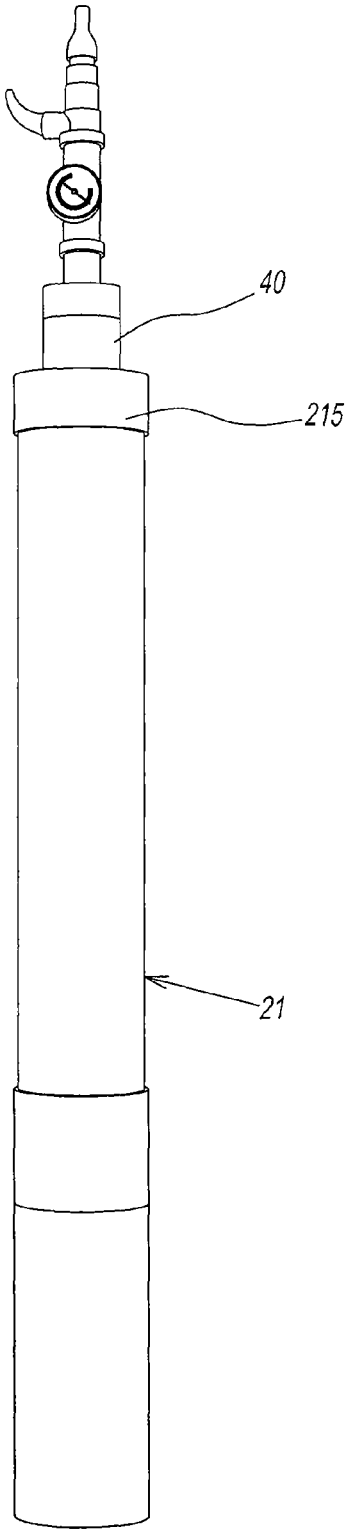
FIG. 9 depicts a top front view of a laboratory pressurized test container used to hold resin cartridges according to the present disclosure.

FIG. 9 depicts pressurized test vessel 215 used in the above examples. The picture shows detail of the pressure vessel and the pressure manifold used to pressurize and monitor the vessel. The resin cartridges are clearly evident through the clear section of the pressure vessel. The test number, storage temperature and storage pressure are recorded on the test vessel. Bulk pressurized container 21 is shown.

Figure 10:
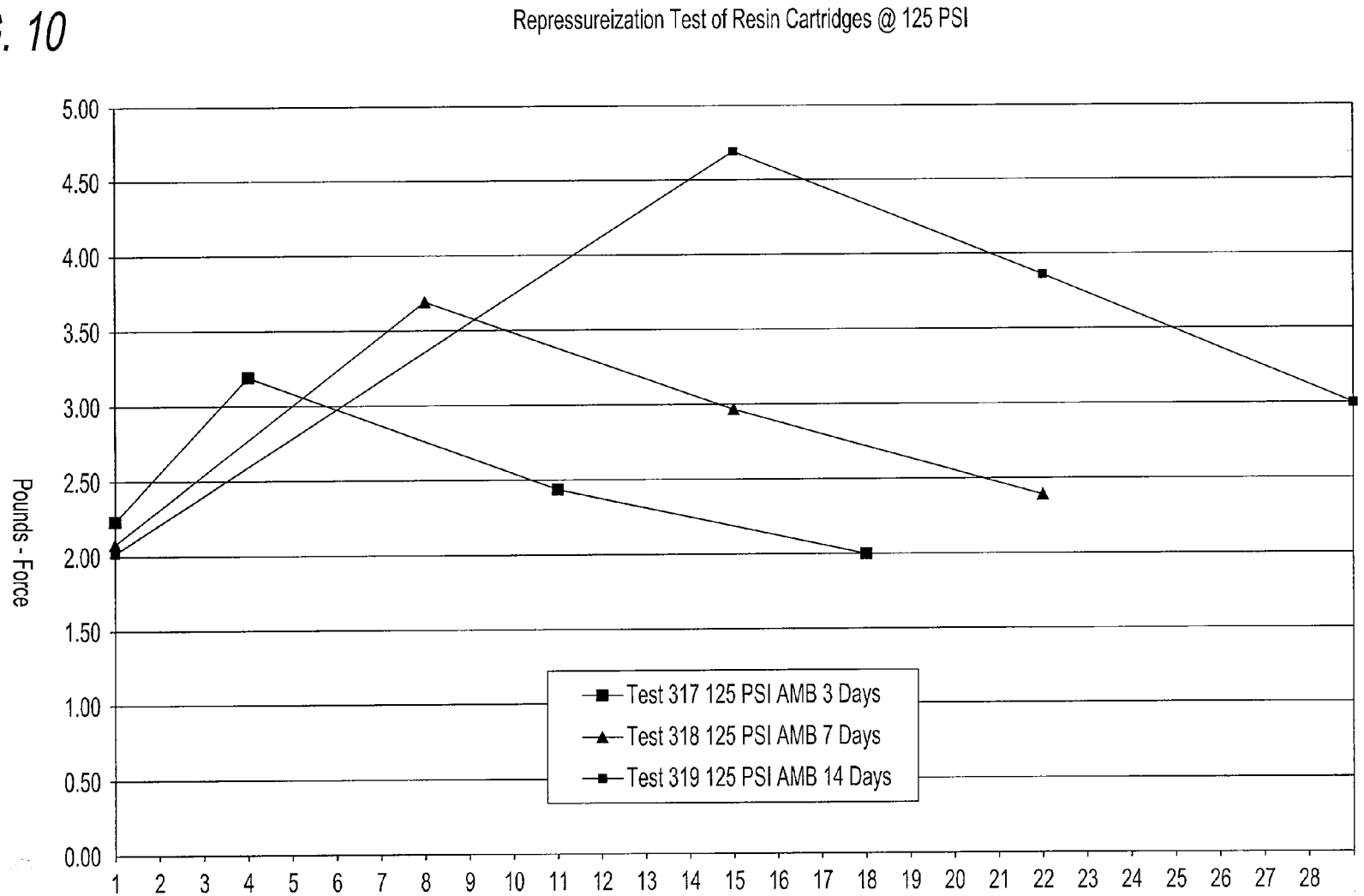
FIG. 10 depicts a graph of the cumulative pressure change of resin cartridges when stored in a pressurized environment of 125 psi above atmospheric pressure, then removed from a pressurized chamber and stored at atmospheric pressure.

FIG. 10 is a graph of the cumulative pressure change of resin cartridges when stored in a pressurized environment of 125 psi above atmospheric pressure, then removed from a pressurized chamber and stored at atmospheric pressure.

Various modifications and variations of this disclosure will be obvious to a worker skilled in the art and it is to be understood that such modifications and variations are to be included within the purview of this application and the spirit and scope of the claims.

What is claimed is:

1. A method for preserving the firmness and internal pressure of a resin cartridge, said method comprising:

inserting a catalyst material into a first compartment of a resin cartridge;

inserting a resin material into a second compartment of a resin cartridge;

pressurizing said first and second compartments;

disposing at least one said resin cartridge into a container; and pressurizing said container wherein internal pressure of said resin cartridge is between about 5 psi to about 25 psi above ambient pressure, and internal pressure of said pressurize container is between about 5 psi to about 60 psi above ambient pressure.

2. The method according to claim 1, wherein resin cartridge comprises a shell which is formed of at least one material selected from the group consisting of a polyethylene terephthalate film, polyethylene naphthalate film, polypropylene film, polyethylene film, and mixtures thereof.

3. The method according to claim 1, wherein said catalyst comprises a peroxide, a liquid that comprises water, glycol, oil, plasticizer or glycerin, solid particulates, a freeze point modifier, and, optionally, a sugar; and said resin material comprises a polymer, a solvent, a surfactant, a wetting agent, viscosity modifiers, a cross-linking agent, promoters, inhibitors and solid particulates.

4. The method according to claim 1, wherein a plurality of resin cartridges are disposed within said pressurized container.

5. The method according to claim 1, wherein said container is pressurized by a pressurizing medium, and wherein said pressurizing medium is any gas or a fluid that lends itself to pressurization.

6. The method of claim 1 wherein the resin cartridge has a high initial firmness and a high initial internal pressure, and a diameter and length, sufficient to fit inside a borehole in a mine or tunnel; wherein said resin cartridge is operationally compatible with mechanisms and machinery used to fit said resin cartridge inside said borehole; and wherein said resin cartridge has a volume that meets ASTM F432 minimum volume specifications.

* * * * *